US008186676B2

(12) United States Patent
Urban et al.

(10) Patent No.: US 8,186,676 B2
(45) Date of Patent: May 29, 2012

(54) APPARATUS AND METHOD FOR REDUCING VIBRATION AND NOISE IN A PRINTER

(75) Inventors: Carl T. Urban, Portland, OR (US); Michael D. Long, Portland, OR (US); Paul Vangasse, Portland, OR (US); Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/248,673

(22) Filed: Oct. 9, 2008

(65) Prior Publication Data

US 2010/0090390 A1 Apr. 15, 2010

(51) Int. Cl.
*B65H 5/02* (2006.01)

(52) U.S. Cl. ..... 271/272

(58) Field of Classification Search ..... 271/272–274, 271/314; 384/215, 441, 439, 418, 419, 125; 492/18, 49, 17, 47, 15

See application file for complete search history.

(56) References Cited

U.S. PATENT DOCUMENTS

| | | | | | |
|---|---|---|---|---|---|
| 2,114,691 | A | * | 4/1938 | Vose | 271/274 |
| 2,367,832 | A | * | 1/1945 | Riesing | 403/163 |
| 4,353,655 | A | * | 10/1982 | Watanabe et al. | 400/144.2 |
| 4,621,802 | A | * | 11/1986 | Ishida et al. | 271/272 |
| 4,772,151 | A | * | 9/1988 | Lammers et al. | 403/162 |
| 4,809,975 | A | * | 3/1989 | Lee | 482/110 |
| 4,850,584 | A | | 7/1989 | Watashi | |
| 5,029,845 | A | * | 7/1991 | Simpson-Davis | 271/262 |
| 5,163,669 | A | * | 11/1992 | Hurd et al. | 271/125 |
| 5,282,710 | A | * | 2/1994 | Triesethau | 411/544 |
| 5,295,671 | A | | 3/1994 | Nakagaki et al. | |
| 5,413,536 | A | | 5/1995 | Wong et al. | |
| 5,815,186 | A | * | 9/1998 | Lewis et al. | 347/101 |
| 5,838,354 | A | * | 11/1998 | Yamada et al. | 347/101 |
| 6,857,631 | B2 | | 2/2005 | Morrison et al. | |
| 7,036,920 | B2 | * | 5/2006 | Rousseau et al. | 347/103 |
| 2004/0262837 | A1 | * | 12/2004 | Hamada et al. | 271/272 |
| 2005/0134632 | A1 | * | 6/2005 | Rousseau | 347/31 |
| 2006/0290068 | A1 | * | 12/2006 | Berdichevsky et al. | 277/549 |
| 2007/0000966 | A1 | * | 1/2007 | Tsusaka et al. | 226/101 |
| 2008/0111318 | A1 | * | 5/2008 | Tomoyasu | 277/590 |

FOREIGN PATENT DOCUMENTS

| | | | |
|---|---|---|---|
| EP | 1058017 | * | 12/2000 |
| JP | 62-124317 | * | 6/1987 |
| JP | 6-58333 | * | 3/1994 |

* cited by examiner

*Primary Examiner* — Gerald McClain
*Assistant Examiner* — Thomas Morrison
(74) *Attorney, Agent, or Firm* — Maginot, Moore & Beck, LLP

(57) ABSTRACT

An apparatus for transporting media in a printer helps reduce vibration and noise in the printer. The apparatus includes a pair of brackets secured to a printer surface, a shaft, a first portion of the shaft being secured within one of the brackets and a second portion of the shaft being secured within the other bracket, a roller mounted about the shaft for rotation about the shaft, and a pair of vibration dampeners, one vibration dampener being interposed between the first portion of the shaft and the one bracket, and the other vibration dampener being interposed between the second portion of the shaft and the other bracket.

6 Claims, 8 Drawing Sheets

APPARATUS AND METHOD FOR REDUCING VIBRATION AND NOISE IN A PRINTER

TECHNICAL FIELD

The apparatus and method described below relate to vibration and noise reduction in a printer, and more particularly, to vibration and noise reduction caused by shaft vibrations in media transport systems in a printer.

BACKGROUND

In a typical printer, media trays store media sheets within the printer. During the printing cycle, a media transport system retrieves media sheets from a tray, routes the media through the printer to receive an image, and then ejects the media into an output tray for collection by a user. The media transport system utilizes drive rollers and idler rollers to transport media through the printing process. Drive rollers are fixedly mounted about shafts that are coupled to the rotational output of an electrical motor or other actuator. As the shafts rotate in response to the rotational output of a motor, the drive rollers also rotate. Idler rollers are mounted for rotation about an idler shaft that is engaged to a printer surface. Typically, the idler rollers are positioned opposite drive rollers, and a biasing member acting on an idler shaft presses the idler rollers against the drive rollers. As the drive rollers rotate, they frictionally engage the idler rollers sufficiently to rotate the idler rollers. As a media sheet contacts a drive roller and idler roller junction, known as a nip, the rotating rollers propel the sheet through the media path. Thus, the idler rollers assist in the movement of media sheets through the printer without requiring additional actuators for their rotation.

Idler shafts are secured to the printer surface in various ways that enable the shafts to move in a direction normal to the surface of the media to compensate for media sheets of different thicknesses that may be retrieved from different trays. To illustrate, consider that the idler rollers and the drive rollers contact one another in the absence of a media sheet in the nip. As a media sheet enters the nip, the thickness of the media forces the idler roller to separate from the drive roller. After the sheet exits the nip, the idler roller drops to its previous position to reengage the drive roller. Thus, the floating attachment of the idler shaft to the printer surface enables the idler roller to compensate for media sheets of different thicknesses.

One example of such a floating attachment fits the terminal ends of an idler shaft within slotted brackets having two opposing sidewalls, while a biasing member, such as a spring, urges the shaft against a printer surface. In this arrangement, the sidewalls limit the movement of the idler shaft in a direction parallel to the direction of media travel. The shaft is free to move in a direction normal to the media surface, subject to the urging of the biasing member, which helps hold the shaft within the bracket. While this structure helps effectively form a media nip for transporting media along a path, it also permits an idler shaft to strike the slotted bracket sidewalls intermittently in response to vibrations exhibited by other printer components. For example, motors, belts, and even the rotation of idler rollers upon startup, may cause an idler shaft to vibrate within a bracket. Furthermore, the structures to which the brackets are connected may amplify the vibrations and generate objectionable noise.

The materials used to manufacture the idler shaft, bracket, and biasing member may at times also contribute to the generation of undesirable noise. Manufacturers may construct the idler shaft and the brackets from any number of materials, but often rigid plastic is used for its workability and durability. However plastic-to-plastic interfaces, such as the contact points between the shaft and the bracket, are susceptible to generating noise when the rigid materials vibrate and impact one another. Furthermore, the above described vibrations may also contribute to the generation of noise at the biasing member and idler shaft interface, because manufacturers often construct the biasing member of a rigid material. Of course, these noise sources do not decrease the functionality of the printer, but some users may prefer a quieter printer.

In order to eliminate the vibration, and any noise that may arise from such vibrations, manufacturers have looked to various vibration dampening methods. For example, biasing springs may force the idler shaft to one side of the bracket in an effort to reduce the associated "chatter" between the idler shaft and the bracket. This complicated system requires the selection of a biasing means of sufficient strength to reduce chatter without unnecessarily restricting the desired movement of the shaft. Simpler vibration dampening systems are therefore desirable.

SUMMARY

An apparatus for transporting media in a printer has been developed that helps reduce vibration and noise in the printer. The apparatus includes a pair of brackets secured to a printer surface, a shaft, a first portion of the shaft being secured within one of the brackets and a second portion of the shaft being secured within the other bracket, a roller mounted about the shaft for rotation about the shaft, and a pair of vibration dampeners, one vibration dampener being interposed between the first portion of the shaft and the one bracket, and the other vibration dampener being interposed between the second portion of the shaft and the other bracket.

Likewise, a method may be implemented in a printer that helps reduce noise and vibration in the printer. The method includes securing a first portion of a shaft within a first bracket mounted to a printer surface, securing a second portion of the shaft within a second bracket mounted to the printer surface, and coupling a vibration dampener to the shaft to dampen vibrations of the shaft within the two brackets.

BRIEF DESCRIPTION OF THE DRAWINGS

Features for reducing vibrations and noise in a media transport apparatus in a printer are discussed with reference to the drawings.

DETAILED DESCRIPTION

Figure 1:
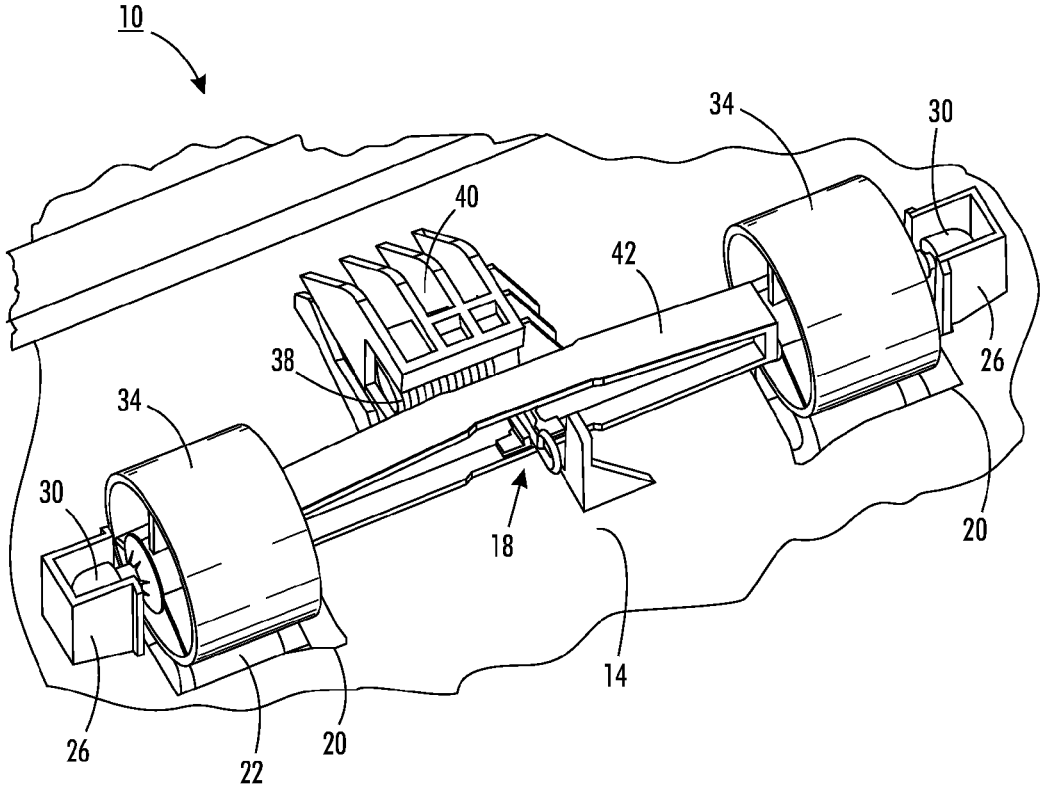
FIG. 1 is a perspective view of a printer.

The term "printer" refers, for example, to reproduction devices in general, such as printers, facsimile machines, copiers, and related multi-function products. FIG. 1 depicts an exemplary media transporting apparatus in a printer. The printer 10 includes brackets 26 secured to a printer surface 14 and a shaft 42 movably engaged within the brackets 26. Idler rollers 34 are mounted about the shaft 42 for rotation. The brackets 26 are shown mounted on the printer surface 14 near the terminal ends of the shaft 42, but similar brackets may be alternatively or additionally located interior of the idler rollers 34. As used herein, the term bracket is intended to encompass the full range of mounting, constraining, securing, supporting, and other positioning and/or position limiting functions that a bracket, tab, boss, post, pin, or other similar part or structure may provide. Brackets may be configured as one more parts and/or some or all portions of a bracket may be formed, molded, or otherwise incorporated into other parts or structures. Examples of bracket configurations and functions are described below in context with some objective examples to emphasize the constraints and motion flexibility required. This bracket function is generally termed as simply bracket for convenience.

End caps 30 are frictionally engaged to each terminal end of the shaft 42. Drive rollers 22 are coupled to an actuator on an opposite side of the printer surface 14. Each drive roller 22 engages a respective idler roller 34 to form a nip, visible through the printer surface openings 20. Rollers are generally traction devices used to move media, but may also or otherwise be used for guidance of media. Two idler rollers 34 and two drive rollers 22 are shown, but the shaft 42 may accommodate additional rollers, which may be arranged in pairs. A holder 40 secures a biasing member 38 to the printer surface 14. The holder 40 enables a portion of the biasing member 38 to engage a slot or biasing surface on shaft 42. As shown in FIG. 1, the biasing member 38 can be a spring, although other types of biasing members may be used. The biasing member 38 applies a force to the shaft 42 that directs the idler rollers 34 toward the drive rollers 22. FIG. 1 illustrates only one biasing member 38; however, additional biasing members 38 may be arranged with reference to the locations of the idler rollers 34 and the brackets 26. The portion of the printer 10 illustrated in FIG. 1 transports media 46, shown in FIG. 2, of different thicknesses along a media path.

Figure 2:
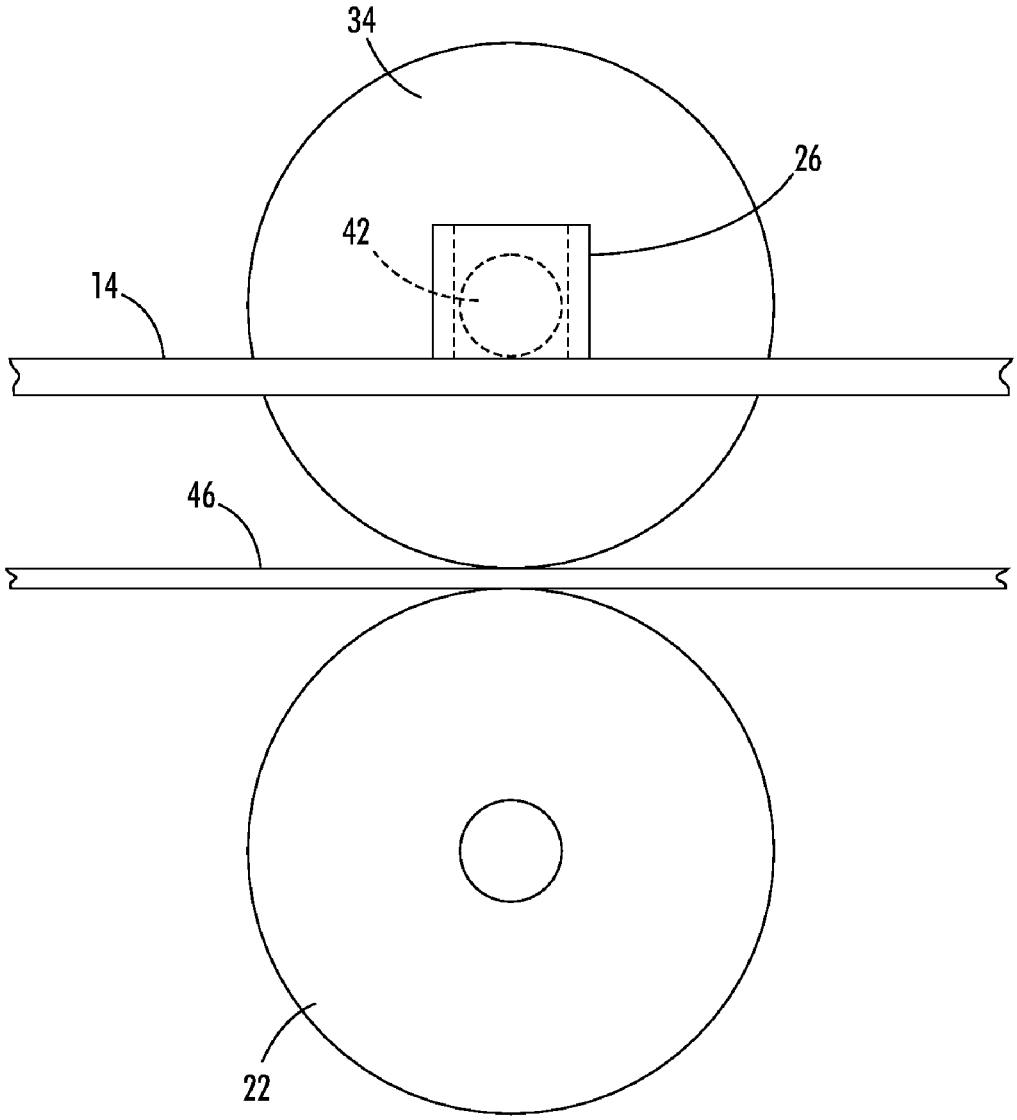
FIG. 2 PRIOR ART
FIG. 2 is a perspective side view of the interface between an idler roller and a drive roller with a media sheet interposed within the nip.

As shown in FIG. 2, a prior art method uses brackets 26 to restrain movement of the idler shaft 42 with reference to the printer surface 14. The illustrated brackets 26 form a channel into which the terminal ends of the shaft 42 are inserted. Printer surface 14 forms a floor for the bracket 26, and the vertical sidewalls restrict movement of the shaft 42 in all directions except the one generally normal to the media 46 surface. The terminal ends of the shaft 42 can move in the vertical direction within the bracket 26. If the brackets securing the shaft 42 are located inboard of the idler rollers 34, "U" shaped brackets can be utilized. The "U" shaped brackets feature three vertical sides. This bracket also restricts movement of the shaft 42 parallel to the media surface, but permits the shaft 42 to move in response to the introduction of media 46 in the nip. Each of the described brackets may also include an encapsulating top side to ensure the shaft 42 remains within the bracket should excessive upward force be applied to the shaft 42. The apparatus does not require a bracket top side, however, because the biasing member 38 presses the shaft 42 toward the printer surface 14 to prevent the shaft 42 from exiting the top of the bracket. If the bracket does not include a top side, the height of the vertical sides of the bracket needs to be sufficient to prevent the shaft 42 from exiting the bracket under normal operating conditions.

Figure 3:
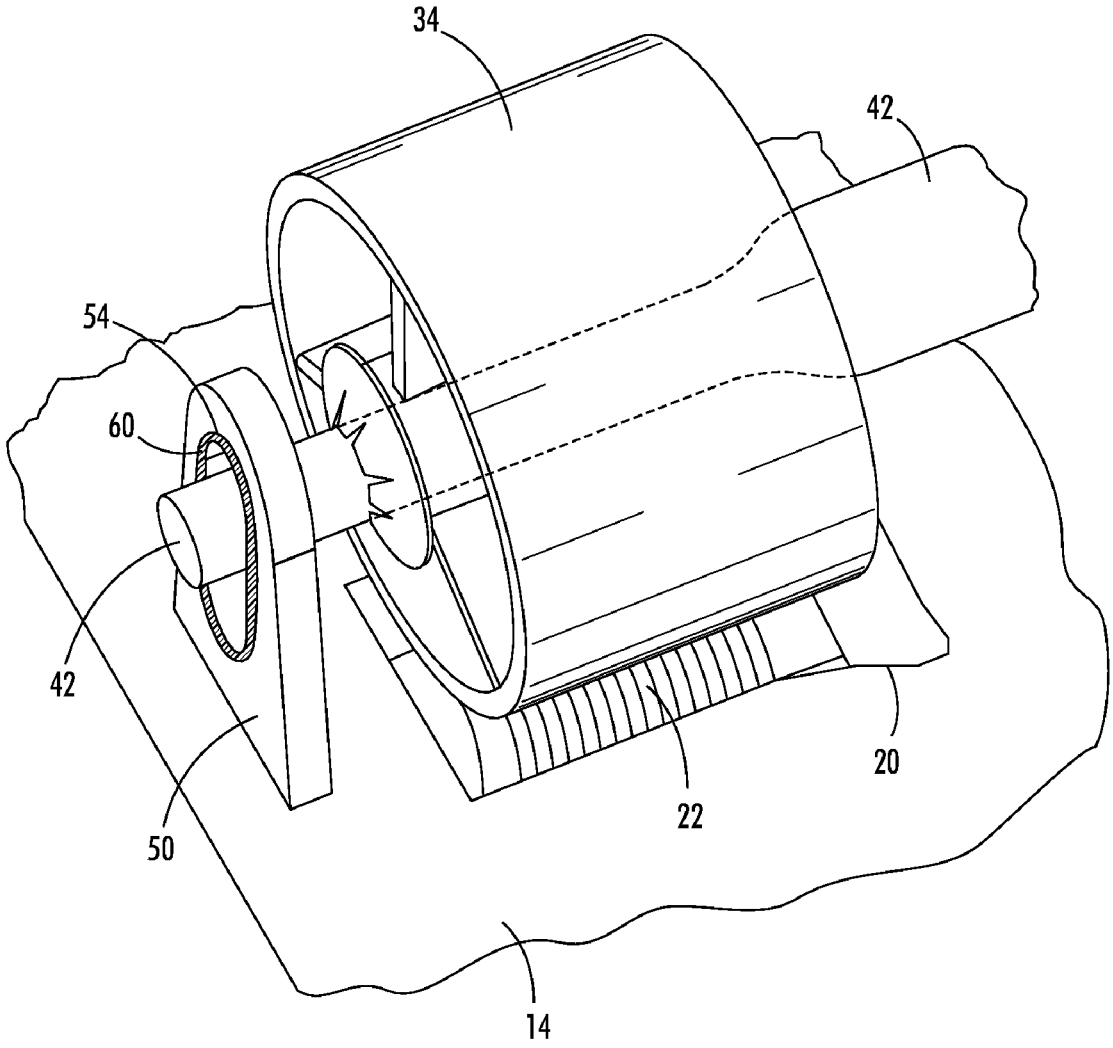
FIG. 3 is an end view of an idler shaft bracket depicting an elastomer applied to the interior of the idler shaft slot.

FIG. 3 illustrates another a bracket designed to restrict movement of the idler shaft 42 with respect to the printer surface 14. The illustrated bracket 50 includes a slot 54, which accepts the terminal end of the shaft 42. The slots 54 are slightly larger than the terminal ends of the shaft 42 to allow the shaft 42 to move in the vertical direction as pictured. As illustrated the slotted bracket 50 is a free standing structure located outboard of the idler wheels 34. However, the slotted bracket 50 could also be located within the channel shaped bracket 26, inboard of the idler wheels 34 as a free standing structure, or inboard of the idler wheels 34 and within the "U" shaped brackets. In each arrangement, the shaft 42 and bracket may generate undesirable noise when vibrations cause the shaft 42 to intermittently strike the bracket structure.

Figure 4:
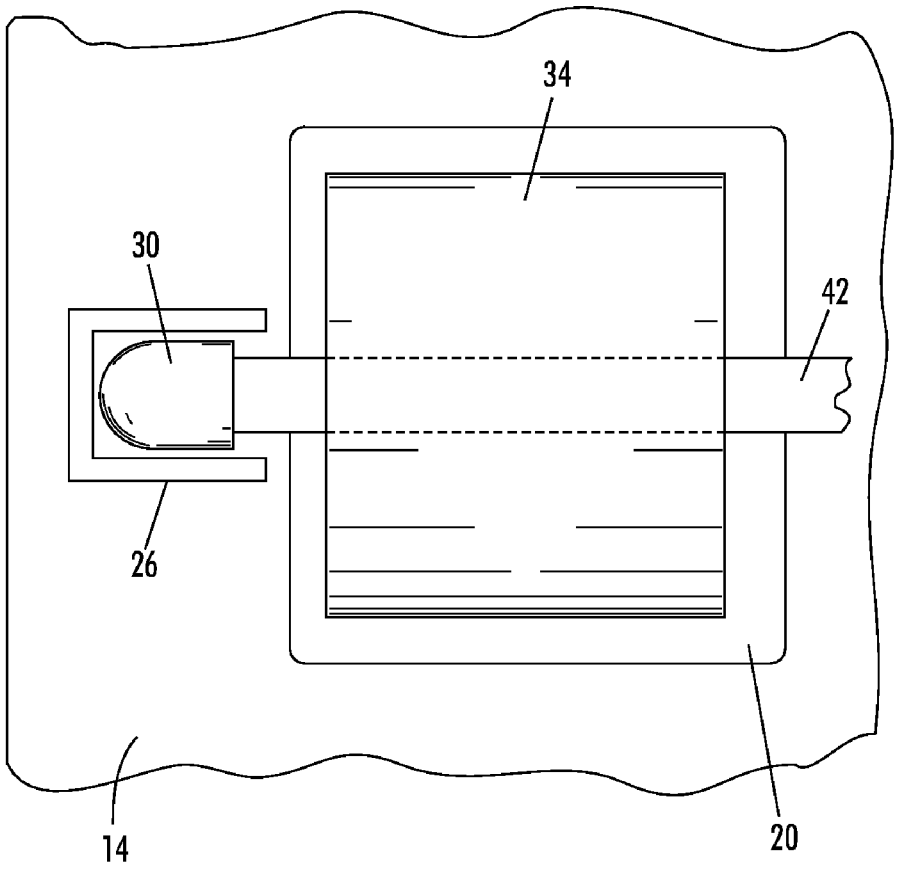
FIG. 4 is a top view of an idler shaft bracket depicting an end cap upon the terminal end of the idler shaft.

To insulate vibrations, and lower the potential of noise generation, a vibration dampener has been applied to the shaft 42 at each point where the shaft 42 contacts a bracket 26. In one embodiment, the dampeners are end caps 30 frictionally engaged to the terminal ends of the shaft 42, such as the one illustrated in FIG. 4. The end caps 30 are generally cylindrical and have an opening to accommodate the terminal end of the shaft 42. The side of the end cap 30 opposite the opening is closed to prevent the terminal end of the shaft 42 from protruding beyond the end cap 30, and also to provide dampening between the terminal end of the shaft 42 and the bracket 26. If the end cap 30 covers the terminal end of a shaft 42 engaged to a slotted bracket 50, however, the side opposite the opening need not be closed, thereby allowing the end cap 30 to take the form of a hollow cylinder. The end caps 30 are sufficiently thick to insulate vibrations experienced by the shaft 42, but not so thick that the shaft 42 becomes immobile within the bracket 26. Thus the end caps 30 do not completely fill the gap between the shaft 42 and the bracket 26, as this may prevent the shaft 42 from moving in response to the introduction of media 46 in the nip. The end caps 30 reduce noise by providing a buffer between the shaft 42 and the brackets 26, such that the end caps 30 insulate or dampen the vibrations generated when the shaft 42 strikes the rigid sides of the bracket 26.

Figure 8A:
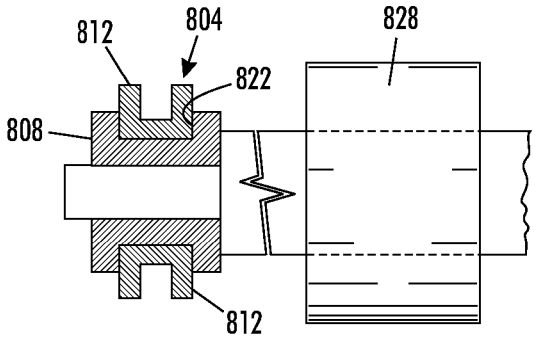
FIGS. 8A, 8B, and 8C are alternative embodiments of brackets that constrain movement of a vibration dampener mounted about an end of a shaft carrying an idler roller.
Figure 8B:
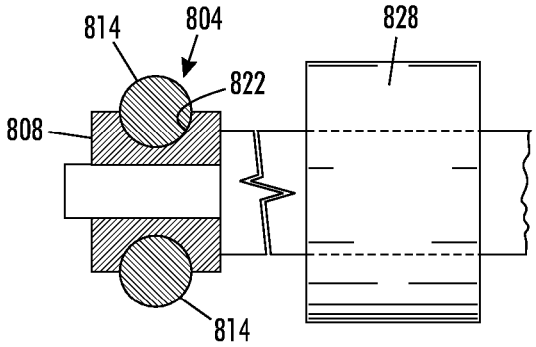
Figure 8C:
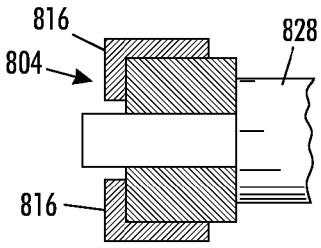

The composition of the end caps 30 impacts the noise level reduction. In one embodiment, the end caps 30 are an elastomeric material, which works particularly well at reducing noise; although, any suitable material that dampens noise or vibration may be utilized, including, but not limited to, rubber, cork, silicone, polyurethane foam, and viscoelastic or elastomeric materials. Also, the brackets and vibration dampeners may be implemented in other configurations. For example, FIG. 8A, FIG. 8B, and FIG. 8C depict alternative embodiments of a bracket 804 and a vibration dampener 808. In these embodiments, the bracket 804 is formed by a set of posts 812 or 814 or by a set of corners 816. In the embodiments of FIG. 8A and FIG. 8B, the posts frictionally fit within grooves 822 in the vibration dampener 808. In the embodiment of FIG. 8C, the corners 816 form an open channel that constrains movement of the vibration dampener 808 and hence the shaft 828. Roller 830 is mounted about the shaft 828 in these various exemplary embodiments.

In another embodiment, the device reduces noise by surrounding each portion of the shaft 42 that contacts a bracket 26 with an elastomeric dampener. In this embodiment the shaft 42 engages the printer surface 14 with brackets that contact the shaft 42 at points other than the terminal ends of the shaft 42. For example, the shaft 42 may be secured to the printer surface 14 with one or more "U" shaped brackets located inboard of the idler rollers 34. In one configuration, the brackets are inverted to entrap the shaft with the "U" portion of the bracket with the surface 14 connected the two ends of the "U" portion. In another configuration, the "U" shaped bracket stands upright with the top being open. This configuration is effective provided the legs of the bracket are sufficiently long enough to keep the shaft within the bracket during its vertical movement. The elastomeric dampeners frictionally engage the portions of the shaft 42 that contact the brackets, without limiting the vertical movement of the shaft 42 in response to media 46 in the nip. The dampeners may have an outer surface that matches the shape of the shaft 42, or they may have an inner channel to engage the shaft 42 and an outer surface that limits contact with the bracket, such as a cylinder or any other appropriate shape. As with end caps 30, the dampeners achieve noise reduction by partially filling the gap between the shaft 42 and the brackets with a material that insulates vibrations.

As opposed to applying a vibration dampener to the shaft 42, noise reduction may also be achieved by securing a vibration dampener to an internal surface of the sidewalls of the bracket 26. FIG. 3 illustrates one such embodiment. The elastomer coating 60 surrounds the portion of the slot 54 that contacts the shaft 42, thus partially filling the gap between the shaft 42 and the slot 54, but still enabling the shaft 42 to move in response to the introduction of media 46 to the nip. In a manner similar to the end caps 30, the elastomer coating 60 dampens the vibrations and any noise that may be generated when the shaft 42 intermittently contacts the slot 54.

The elastomer coating 60 may also be applied to the channel-shaped bracket 26 illustrated in FIG. 2 or the "U" shaped bracket described above. In each of these embodiments the elastomer coating 60 surrounds the internal cavity of the bracket, partially filling the gap between the shaft 42 and the bracket. These embodiments dampen the vibrations and noise that may be generated when the shaft 42 contacts the bracket 26, but still allow the shaft 42 to move in response to the introduction of media 46 to the nip.

The elastomer coating 60 need not surround the entire internal wall of the slot or bracket. For example, a segmented elastomer coating may be secured to the above described brackets and slot 54. The segmented coating utilizes elastomer pieces spaced around the slot 54 or the internal wall of the bracket. The elastomer pieces are spaced such that they are close enough to one another to prevent the shaft 42 from directly contacting the slot 54 or bracket, thereby achieving the same noise and vibration dampening capacity as the continuous elastomer coating 60, but with a reduction in the required amount of elastomer material. The dimensions of the shaft 42 determine the maximum spacing of the elastomer pieces. If the terminal end of the shaft 42 has a circular cross section then the elastomer pieces must be placed closer together as the diameter of the shaft 42 decreases. Similarly, if the terminal end of the shaft 42 has a polygonal cross section then the spacing of the elastomer pieces must be less than the length of the shortest side of the shaft 42 that might contact the slot 54 or bracket.

End caps 30 may or may not be utilized in conjunction with the elastomer coating 60. By using both end caps 30 and the elastomer coating 60, the possibility of unwanted noise generation can be significantly reduced, but either the end caps 30 or the elastomer coating 60 alone provide a satisfactory level of noise reduction.

In a similar manner, vibration and noise generated by the interaction between the biasing member 38 and the shaft 42 may also be reduced. As with the brackets, audible noise may be generated between the shaft 42 and the point at which the biasing member 38 contacts the shaft 42. Furthermore, the vibrations may be transmitted to and amplified by the rigid printer surface 14 because the holder 38 secures the biasing member 38 to the printer surface 14. The introduction of a dampener between the shaft 42 and the biasing member 38 prevents vibrations from traveling through the shaft 42 and to the biasing member 38, thereby reducing noise. The dampener may be formed using materials including, but not limited to, rubber, cork, silicone, polyurethane foam, and viscoelastic or elastomeric materials. Below, specific dampener embodiments are disclosed.

Figure 5:
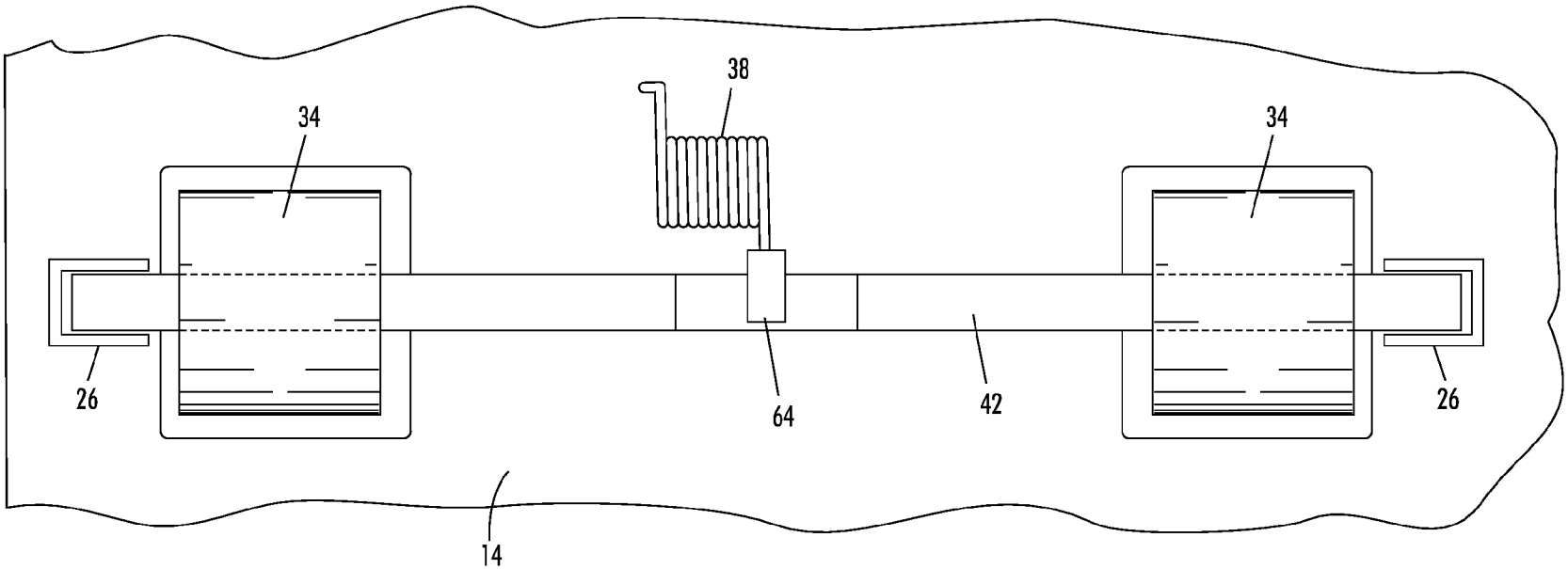
FIG. 5 is a top view of a printer depicting an elastomer material applied to the portion of the biasing member in contact with the idler shaft.

In one embodiment, the device achieves noise reduction by coating the portion of the biasing member 38 that contacts the shaft 42 with an elastomeric material. As illustrated in FIG. 5, an elastomer biasing member cap 64 surrounds the terminal portion of the biasing member 38. The biasing member cap 64 may have a generally cylindrical shape or the cap 64 may be generally cylindrical with a flat surface that engages the shaft 42. In either design, the biasing member cap 64 encapsulates any portion of the biasing member 38 that may contact the shaft 42 with a sufficient thickness of elastomeric material to insulate the vibrations between the biasing member 38 and the shaft 42. The biasing member cap 64 may become frictionally engaged to the shaft 42 without sacrificing utility, so long as the shaft 42 remains capable of movement in response to the introduction of media 46 to the nip.

In an alternative embodiment, the device surrounds the portion of the shaft 42 in proximity to the biasing member 38 with an elastomeric material. In this embodiment, the elastomeric material may be an elastomeric pad 18 non-movably secured to the shaft 42, as illustrated in FIG. 1. The thickness of the elastomeric pad 18 isolates the shaft 42 from the biasing member 38. The elastomeric pad 18 may also include a slot or channel capable of accepting the biasing member 38. The slot or channel ensures that the shaft 42 and the idler rollers 34 remain properly aligned with the drive rollers 22 by limiting the movement of the shaft 42 in the direction approximately perpendicular to the direction of media 46 travel. In this and other implementations of a biasing member, the biasing member may provide a shaft location or positioning influence by constraining the shaft in at least one axis. This constraint may augment or supplant the need for one or more motion constraints at other shaft locations, such as the ends, to ease assembly, take advantage of structure, accommodate limited room or component clearance, or for other reasons.

Figure 6:
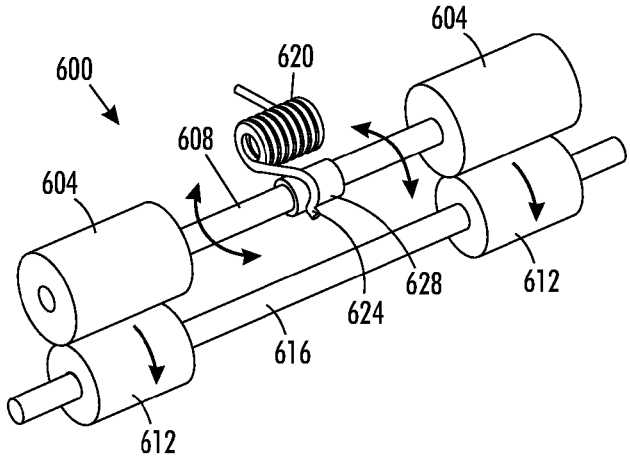
FIG. 6 is a perspective view of a transport mechanism that dampens vibrations with a single dampener.

Another alternative embodiment of a vibration dampener for a media transport mechanism 600 is shown in FIG. 6. In this embodiment, a pair of rollers 604 is mounted about a shaft 608, although the roller may be a generally cylindrical roller. Rollers 612 are mounted about a shaft 616 to form a driver roller, which also may be implemented with a generally cylindrical roller. The shaft 608 and rollers 604 are generally parallel to the shaft 616 and the rollers 612. The shaft 616 is coupled to an actuator (not shown) to enable the shaft 616 and the rollers 612 to be turned selectively in response to signals generated by a controller (not shown). A biasing member 620, which is a spring in FIG. 6, includes a biasing arm 624 that urges the shaft 608 and the rollers 604 against the rollers 612. Thus, rotation of the rollers 612 also turns the rollers 604. Mounted about the shaft 608 is a vibration dampener 628 that is interposed between the biasing arm 624 and the shaft 608. Although the vibration dampener 628 is depicted as a collar of elastomer material, other vibration dampening materials and structures may be used. For example, the spring may be formed a flat bar spring.

Figure 7:
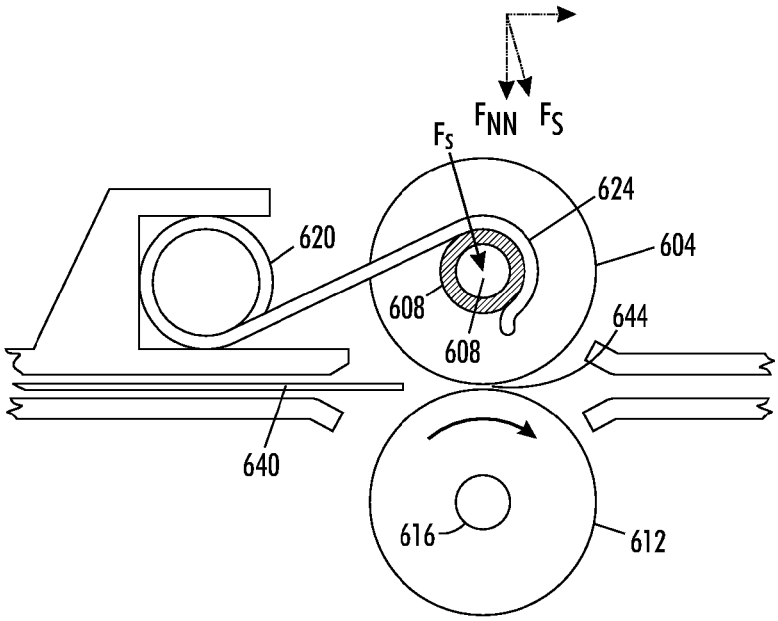
FIG. 7 is a side view of the transport mechanism shown in FIG. 6.

A side view of the transport mechanism 600 is shown in FIG. 7. This view includes a media sheet 640 approaching the nip 644 formed between roller 604 and roller 612. As shown by the force diagram over the roller 604, the spring 620 is positioned so the spring force $F_s$ has a normal component $F_n$ and a bias component $F_b$. The normal component is sufficient to provide adequate friction for the roller 612 to drive the roller 604, while the bias component helps hold the shaft 608 within the bend of biasing arm 624.

Figure 9A:
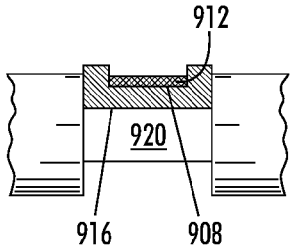
FIGS. 9A and 9B are alternative embodiments of biasing members that urge a shaft in one direction and a vibration dampener is interposed between the biasing member and the shaft.
Figure 9B:
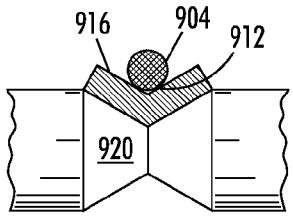
Figure 10:
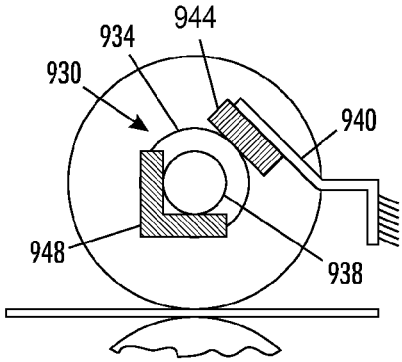
FIG. 10 is an alternative embodiment in which a biasing member urges a shaft against a corner bracket and a vibration dampener is interposed between the shaft and the biasing member.

In other embodiments, the vibration dampener may conform to a groove within the shaft carrying the rollers. For example, as shown in FIGS. 9A and 9B, the spring may be a cylindrical wire 904 or a flat bar 908 that fits within a groove 912 in a vibration dampener 916. The vibration dampener 916 is interposed between the spring 904 or 908 and the shaft 920. Alternatively, as shown in FIG. 10, a shaft 930 may have a first circumference 934 and a reduced circumference 938 at the outboard ends. A biasing member 940 applies a force against the circumference 934 where a vibration dampener 944 is interposed between the biasing member and the circumference 934. The biasing member applies the force in a direction that urges the reduced shaft end 938 against the corner bracket 948. Thus, the biasing member 940 helps keep the shaft 930 constrained within the bracket 948 and the vibration dampener 944 helps reduce the noise.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

We claim:

1. An apparatus for transporting media in a printer comprising:

a first bracket and a second bracket secured to a printer surface;

a stationary shaft extending between the first bracket and the second bracket, a first terminal end of the shaft being inserted into the first bracket and a second terminal end of the shaft being inserted in the second bracket;

a first roller rotatably mounted about the shaft; a second roller forming a nip with the first roller and a pair of elastomeric end caps, a first elastomeric end cap configured with a single opening to receive and directly contact each portion of the first terminal end of the shaft inserted into the first bracket to constrain movement of the first elastomeric end cap and the first terminal end of the shaft in a direction parallel to a media surface in the nip formed between the first roller and the second roller and to enable movement of the first elastomeric cap and the first terminal end of the shaft in a direction normal to the media surface in the nip formed between the first roller and the second roller, and a second elastomeric end cap configured with a single opening to receive and directly contact each portion of the second terminal end of the shaft inserted into the second bracket to constrain movement of the second elastomeric end cap and the second terminal end of the shaft in the direction parallel to the media surface in the nip formed between the first roller and the second roller and to enable movement of the second elastomeric cap and the second terminal end of the shaft in the direction normal to the media surface in the nip formed between the first roller and the second roller, the pair of elastomeric end caps being configured to reduce noise.

2. The media transport apparatus of claim 1 wherein the first roller is rotatably mounted about the shaft proximate the first terminal end of the shaft; and the apparatus further comprises:

a second roller rotatably mounted about the shaft proximate to the second terminal end of the shaft.

3. The media transport apparatus of claim 1 further comprising:

a biasing member coupled to the shaft to urge the shaft toward the printer surface; and a vibration dampener interposed between the shaft and the biasing member.

4. The media transport apparatus of claim 3 wherein the vibration dampener is an elastomeric material surrounding a portion of the biasing member coupled to the shaft.

5. The media transport apparatus of claim 3 wherein the vibration dampener is an elastomeric material secured to the printer surface and that contacts a portion of the biasing member coupled to the shaft.

6. The media transport apparatus of claim 1 further comprising:

a biasing member operatively connected to the shaft to urge the shaft towards the printer surface; and a vibration dampener interposed between the printer surface and the shaft.

* * * * *